US007438587B2

(12) United States Patent
Germani

(10) Patent No.: US 7,438,587 B2
(45) Date of Patent: Oct. 21, 2008

(54) MULTIPOLAR ELECTRICAL CONNECTOR WITH SPRING CONTACTS

(75) Inventor: Emilio Germani, Legnano (IT)

(73) Assignee: Industria Lombarda Materiale Elettrico I.L.M.E. S.p.A., Milan (IT)

( * ) Notice: Subject to any disclaimer, the term of this patent is extended or adjusted under 35 U.S.C. 154(b) by 0 days.

(21) Appl. No.: 11/705,421

(22) Filed: Feb. 13, 2007

(65) Prior Publication Data

US 2007/0207662 A1 Sep. 6, 2007

(30) Foreign Application Priority Data

Mar. 2, 2006 (IT) ..... MI2006A0373

(51) Int. Cl.
*H01R 11/20* (2006.01)

(52) U.S. Cl. ..... 439/441

(58) Field of Classification Search ..... 439/436–441, 439/409, 417, 835–838
See application file for complete search history.

(56) References Cited

U.S. PATENT DOCUMENTS 5,110,305 A * 5/1992 Edgley et al. ..... 439/441
5,494,456 A * 2/1996 Kozel et al. ..... 439/441
5,622,517 A * 4/1997 Heng et al. ..... 439/417
5,685,735 A * 11/1997 Hohorst ..... 439/441
5,915,991 A * 6/1999 Roman ..... 439/441
5,993,270 A * 11/1999 Geske et al. ..... 439/835
6,048,223 A * 4/2000 Bechaz et al. ..... 439/417
6,074,241 A * 6/2000 Patel et al. ..... 439/441
6,074,242 A * 6/2000 Stefaniu et al. ..... 439/441
6,126,494 A * 10/2000 Fuchs et al. ..... 439/835
6,146,187 A * 11/2000 Pallai ..... 439/441
6,146,217 A * 11/2000 Osada ..... 439/835
6,280,233 B1 * 8/2001 Beege et al. ..... 439/441
6,428,343 B1 * 8/2002 Landis et al. ..... 439/441
6,500,020 B2 * 12/2002 Vo et al. ..... 439/409
6,682,364 B2 * 1/2004 Cisey ..... 439/441
6,712,649 B2 * 3/2004 Mano et al. ..... 439/835
6,783,385 B2 * 8/2004 Rudy ..... 439/438
6,796,830 B2 * 9/2004 Suss et al. ..... 439/409
6,851,967 B2 * 2/2005 Miyoshi et al. ..... 439/441
6,893,286 B2 * 5/2005 Drewes et al. ..... 439/441
7,004,781 B2 * 2/2006 Walter ..... 439/441
7,014,497 B2 * 3/2006 Lange ..... 439/441
7,083,463 B2 * 8/2006 Steinkemper et al. ..... 439/441
7,104,833 B2 * 9/2006 Oesterhaus ..... 439/441
7,115,001 B1 * 10/2006 Brockman et al. ..... 439/828
7,238,043 B2 * 7/2007 Reibke et al. ..... 439/441
7,249,963 B2 * 7/2007 Ramm ..... 439/437
2001/0053625 A1 * 12/2001 Vo et al. ..... 439/409
2002/0187670 A1 * 12/2002 Cisey ..... 439/441
2003/0008569 A1 * 1/2003 Matsumoto et al. ..... 439/835
2003/0194918 A1 * 10/2003 Fricke et al. ..... 439/835
2004/0152355 A1 * 8/2004 Rudy ..... 439/438

(Continued)

*Primary Examiner*—Ross N Gushi
(74) *Attorney, Agent, or Firm*—Young & Thompson

(57) ABSTRACT

A multipolar electrical connector with spring contacts has, for each conductor to be joined to the connector, a first substantially cylindrical aperture adapted to receive the conductor and a second aperture, parallel to the first aperture, adapted to receive an actuator pin which, sliding in the second aperture, according to its position acts on a spring contact of the connector to lock the conductor to the connector or to release it from the connector. When the conductor is blocked in the connector by the spring contact, the actuator pin is inserted completely into the connector.

7 Claims, 4 Drawing Sheets

U.S. PATENT DOCUMENTS

2004/0161962 A1* 8/2004 Kikuchi ..... 439/441
2004/0248457 A1* 12/2004 Walter ..... 439/441
2005/0042912 A1* 2/2005 Drewes et al. ..... 439/441
2006/0063419 A1* 3/2006 Steinkemper et al. ..... 439/441
2006/0063420 A1* 3/2006 Reibke et al. ..... 439/441
2006/0128206 A1* 6/2006 Oesterhaus ..... 439/441
2007/0099479 A1* 5/2007 Holterhoff et al. ..... 439/441

* cited by examiner

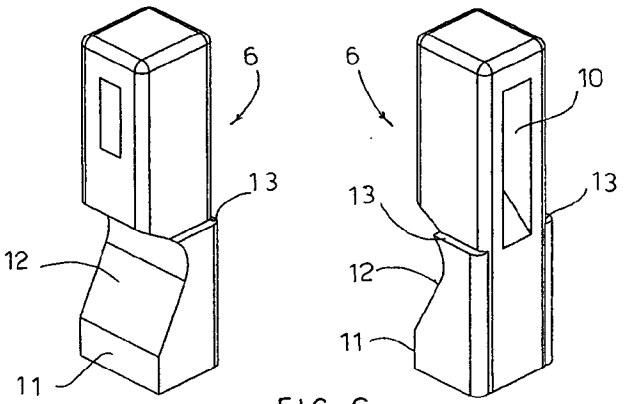
FIG. 6
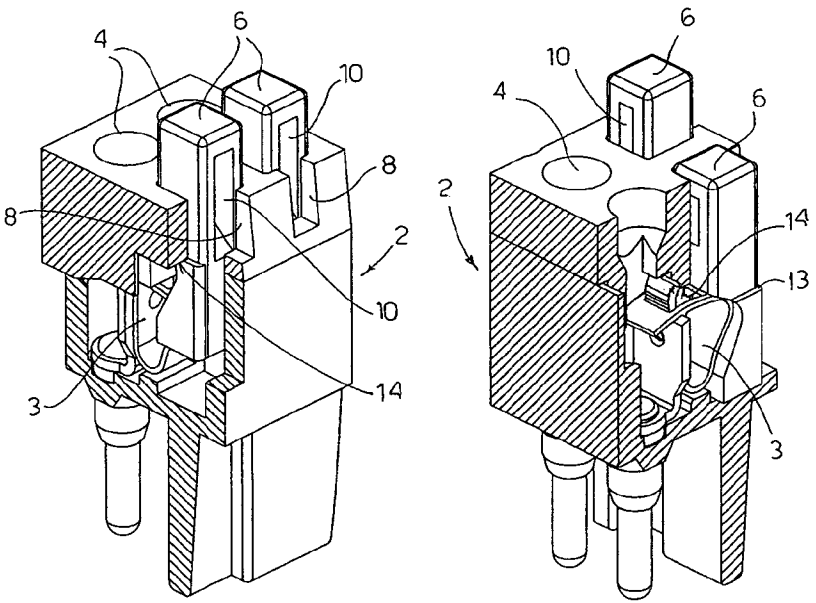
FIG. 8
FIG. 7

MULTIPOLAR ELECTRICAL CONNECTOR WITH SPRING CONTACTS

The present invention refers to an improved multipolar electrical connector with spring contacts.

Multipolar electrical connectors in which each conductor is joined to the connector by means of a spring contact are known to the art and available on the market; for each conductor to be joined to the connector, said connectors have a first aperture adapted to receive the conductor and a second aperture, parallel to the first aperture, adapted to receive the tip of a screwdriver which, sliding in the second aperture, acts on the spring contact to lock the conductor in the connector, or to release it from the connector.

The multipolar electrical connectors with spring contacts currently available will not be further described because they are per se known; however, it will be recalled that, to lock the conductors to the connector:

- in one type of connector (described, for example, by DE 3 418 536) instead of the tip of a screwdriver use is made of pins of insulating material which must be removed from the connector and eliminated (or retained to release a conductor from the connector at a later time);
- in a connecting device for round industrial plugs and sockets (described, for example, by EP 1 072 067) pins are pushed inside the connector to leave protruding only their upper end, which has gripping means (for example a loop) adapted to allow the actuator pin to be extracted from the connector to release the conductor from the connector.

The above mentioned multipolar electrical connectors present various drawbacks, amongst which, for example, there is the fact that, at least before the wiring of the connector, the actuator pins protrude from the connector and can come out of their seat, thus making the wiring of the connector and/or the possible release of a conductor from the connector difficult and complex.

If the actuator pins are removed from the connector at the time of wiring said connector, the need to eliminate them (or to save them for a possible re-use) increases the cost of the handling and of the installation of the connector.

Furthermore, the pins are placed on the inside of the connector with respect to the conductors, which makes the wiring of the connector and/or the release of a conductor from the connector awkward.

Object of the present invention is to produce a multipolar electrical connector with spring contacts adapted to overcome the limits of the electrical connectors of the prior art; this object is achieved by means of an electrical connector that has the characterising features illustrated in claim 1.

Further advantageous characteristics of the invention form the subject matter of the dependent claims.

The invention will now be described with reference to purely exemplifying (and therefore non limiting) embodiments thereof, illustrated in the appended figures, wherein:

FIG. 6 shows diagrammatically two perspective views of an actuator pin;

FIGS. 7 and 8 show diagrammatically, in perspective, two portions of the multipolar electrical connector of FIGS. 1 and 2, sectioned along two planes at right angles;

In the appended figures corresponding elements will be identified by the same reference numerals.

Figure 1:
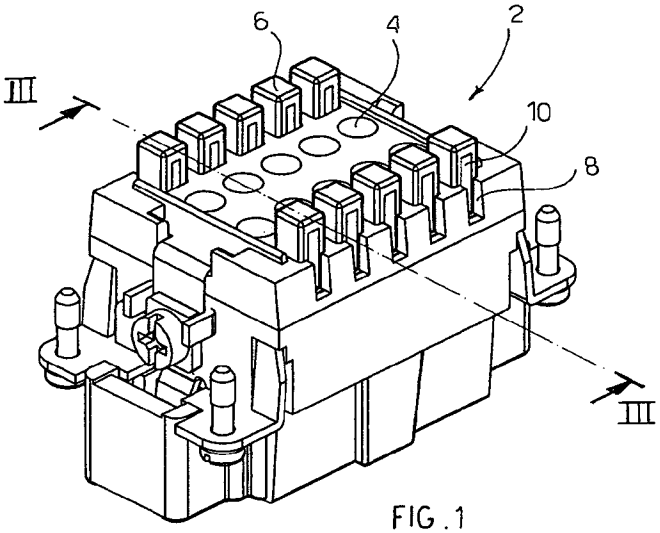
FIG. 1 shows diagrammatically a perspective view of a multipolar connector, produced according to the invention, ready for the wiring of a plurality of conductors.

In the appended figures, 1 denotes an element belonging to a multipolar electrical connector 2; 2 denotes the connector; 3 denotes the spring contacts (not further described being per se known) belonging to the connector 2; 4 denotes a first aperture (present in the connector 2) adapted to receive a conductor 7 to be joined to the connector 2; 5 denotes a second aperture (present in the connector 2) parallel to the first aperture 4; 6 denotes an actuator pin which, sliding in a second aperture 5, acts on a spring contact 3 of the connector 2 to lock the conductor 7 in the connector 2 and to release it from the connector 2, respectively; 7 denotes the conductors to be joined to the connector 2.

Figure 4:
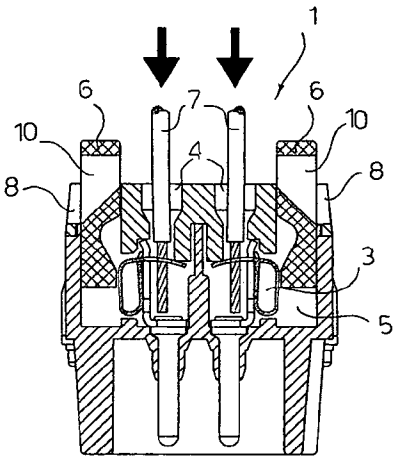
FIG. 4 shows diagrammatically the element of FIG. 3 with a pair of conductors inserted in said element.

FIG. 1 shows diagrammatically a perspective view of a multipolar connector 2 ready for the wiring of a plurality of conductors 7 (FIG. 4); FIG. 1 shows the first apertures (only one of which is identified with the reference numeral 4), the actuator pins (only one of which is identified with the reference numeral 6) partially extracted from the second apertures 5 (not visible in FIG. 1 because they are occupied by the pins 6), the windows (only one of which is identified with the reference numeral 8) present in the upper part of each of the side walls of the connector 2 and adjacent the second apertures 5 and the seats (only one of which is identified with the reference numeral 10) present in the upper part of each actuator pin 6.

Figure 3:
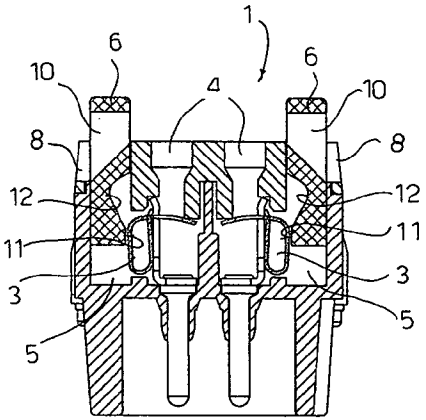
FIG. 3 shows diagrammatically the multipolar connector of FIG. 1 sectioned along the plane III-III to show an element of said multipolar connector ready for the wiring of a pair of conductors.

The actuator pins 6 partially extracted from the second apertures 5 can be seen better, in section, in FIGS. 3 and 4.

As can be seen from FIG. 1, the second apertures 5 are adjacent one of the side walls of the connector 2 and the actuator pins 6 are therefore not hidden from the operator by the conductors 7 when they are inserted into the first apertures 4, situated on the inside of the connector 2 with respect to the second apertures 5, making the wiring of the connector 2 easier; moreover each of the second apertures 5 is connected to the outside by one of the windows 8 situated in the upper part of the side walls of the connector 2.

Figure 2:
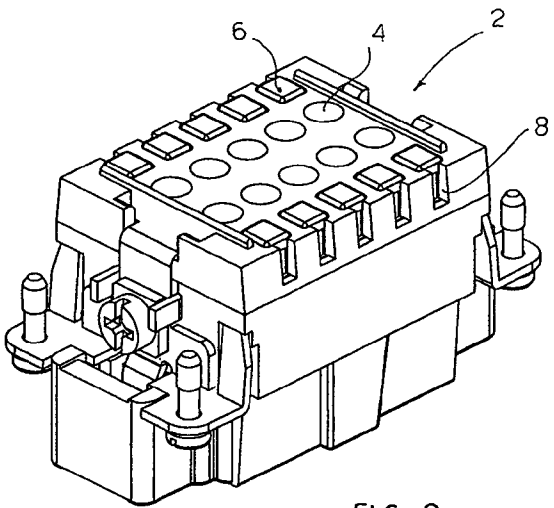
FIG. 2 shows diagrammatically the multipolar connector of FIG. 1 with the actuator pins completely inserted into the connector.

FIG. 2 shows diagrammatically the multipolar connector 2 of FIG. 1 with the actuator pins 6 completely inserted in said connector.

Figure 5:
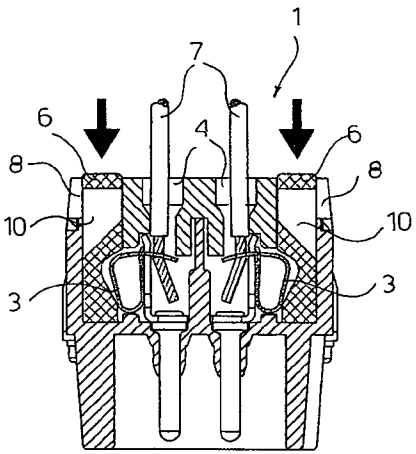
FIG. 5 shows diagrammatically the element of FIG. 4 with a pair of conductors locked in said element.

The actuator pins 6 completely inserted in the second apertures 5 of the connector 2 can be seen better, in section, in FIG. 5.

FIG. 3 shows diagrammatically the multipolar connector 2 of FIG. 1 sectioned along the plane III-III to show an element 1 of the multipolar connector 2 ready for the wiring of a pair of conductors 7 (FIG. 4).

In FIG. 3 the actuator pins 6 are partially extracted from the element 1, so that their bottom end 11 (FIG. 6) compresses the spring contacts 3, opening them and allowing the insertion of the conductors 7, as shown in FIG. 4.

Figure 9:
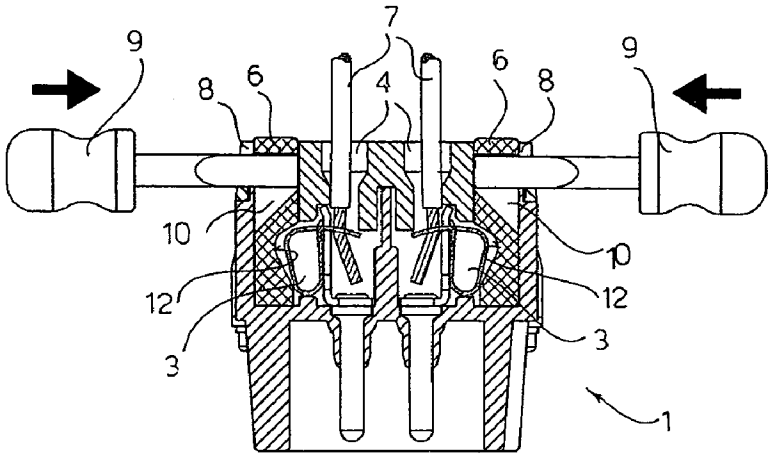
FIGS. 9 and 10 show diagrammatically two steps of the procedure for releasing a conductor from the element of FIG. 5.
Figure 10:
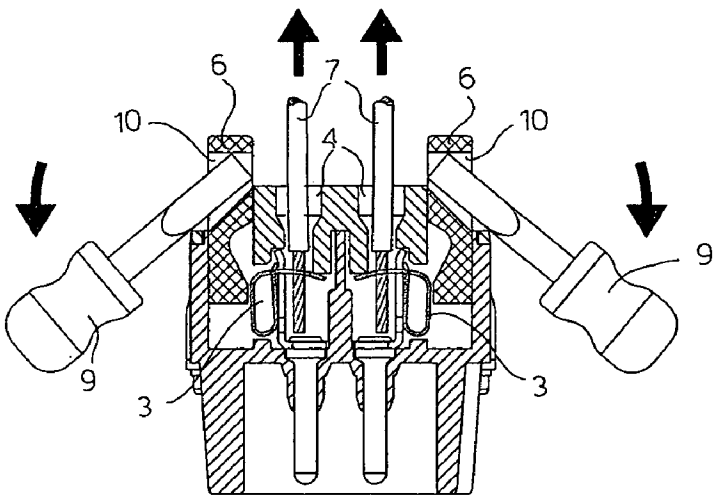

In the upper part of an actuator pin 6, opposite the end 11 acting on a spring contact 3, there is a seat 10 adapted to receive a tool, denoted by 9 in FIGS. 9 and 10.

FIG. 4 shows diagrammatically the element 1 of FIG. 3 with a pair of conductors 7 inserted into the apertures 4 and into the spring contacts 3, as indicated by the arrows in FIG. 4.

FIG. 5 shows diagrammatically the element 1 of FIG. 4 with the conductors 7 locked in the spring contacts 3 by inserting (as indicated by the arrows in FIG. 5) the actuator pins 6 in the element 1: the seats 12 (FIG. 6) of the actuator pins 6, adjacent the ends 11, allow the spring contacts 3 to return to rest, locking the conductors 7 in the connector 2.

From FIG. 5 it can be seen clearly that, when the conductor 7 is locked in the connector 2 by the spring contact 3, the actuator pin 6 is completely inserted in the connector 2.

FIG. 6 shows diagrammatically two perspective views of an actuator pin 6, which is essentially prism-shaped and has at least, in its bottom part, the portion 11 adapted to open the spring contacts 3 (FIGS. 1 and 2) and the seats 12, adjacent the portion 11, which allows the spring contacts 3 to return to rest (FIG. 3).

In its upper part the actuator pin 6 has the seat 10 adapted to receive a tool 9 used to release a conductor 7 from the connector 2, as will be better described with reference to FIGS. 9 and 10.

The actuator pins 6 cannot come out of the second apertures 5 of the element 1 because they are held in place by retaining means consisting of a pair of ridges 14 (only one of which is visible in FIGS. 7 and 8) present on the side walls of the upper part of the second apertures 5 and by a pair of ridges 13 (FIG. 6) present on the side walls of the bottom part of the actuator pins 6, which engage with the ridges 14 to retain the actuator pins in the second apertures 5.

FIGS. 7 and 8 show diagrammatically, in perspective, two portions of the multipolar electrical connector 2 sectioned along two planes at right angles.

In FIGS. 7 and 8 are visible one of the spring contacts 3, two first apertures 4, two actuator pins 6 (having the seat 10) inserted in the relative second apertures 5, two of the windows 8 present in the upper part of the side walls of the connector 2 and one of the ridges 14 present on the side walls of the upper part of the second aperture 5 to retain the actuator pin 6 inside the element 1.

FIG. 7 shows two actuator pins 6 partially inserted in the second apertures 5; FIG. 8 shows an actuator pin 6 partially inserted in the second aperture 5 and the other actuator pin 6 completely inserted in the second aperture 5.

FIGS. 9 and 10 show diagrammatically two steps of the procedure for releasing a conductor 7 from a connector 2 produced according to the invention.

For this purpose, the tool 9 (for example a screwdriver or other functionally equivalent tool) is inserted, through the window 8 present in the upper part of the side wall of the connector 2, into the seat 10 of the actuator pin 6 (FIG. 9) and, by levering with the tool 9 on the bottom edge of the window 8, the actuator pin 6 is raised (FIG. 10), releasing the conductor 7 from the spring contact 3.

The bottom edge of the seat 10 of the actuator pin 6 advantageously slopes downward to limit the extent of the rotation of the tool 9 and to prevent an excessive rotation of the tool 9 from putting an excessive stress on the side wall of the connector 2 (particularly on the bottom edge of the window 8) causing the breakage thereof.

In FIGS. 9 and 10 two tools 9 are visible, which allow the conductors 7 to be released simultaneously from both the spring contacts 3 of an element 1 of the connector 2, but without departing from the scope of the invention the conductors 7 can be released individually from the spring contacts 3 by means of a tool 9, as previously described.

The tool 9 comes into contact only with the walls of the connector 2 and with an actuator pin 6, all made of insulating material, whereas it cannot come into contact with the exposed end of the conductor 7 and/or with parts of the connector (for example, one of the spring contacts 3) electrically connected to the conductor 7, avoiding any risk of electrocution of the operator.

Without departing from the scope of the invention, a person skilled in the art can make to the above described electrical connector all the modifications and/or the improvements suggested by normal experience and/or by the natural evolution of the art.

The invention claimed is:

1. A multipolar electrical connector with spring contacts which has, for each conductor to be joined to the connector, a first aperture adapted to receive the conductor and a second aperture, parallel to the first aperture, adapted to receive an actuator pin which, by sliding in the second aperture according to its position, acts on a spring contact of the connector to lock the conductor to the connector or to release the conductor from the connector, wherein, when the conductor is locked in the connector by the spring contact, the corresponding actuator pin is inserted completely into the connector; and means adapted to retain the actuator pin in the second aperture of the connector, wherein said retaining means comprises a first pair of ridges present on side walls of an upper part of the second aperture and a second pair of ridges present on side walls of a bottom part of the actuator pin, said first and second pair of ridges engaging with each other to retain the actuator pin in the second aperture.

2. A connector as in claim 1, wherein the second aperture is adjacent one of the side walls of the connector.

3. A connector as in claim 1, wherein each first aperture is situated inside the connector with respect to each second aperture.

4. A connector as in claim 1, wherein each second aperture is connected to the outside by a window situated in an upper part of side walls of the connector.

5. A connector as in claim 1, wherein the actuator pin is prism-shaped, such that at one end thereof, at least one portion is adapted to open the spring contact and a seat, adjacent the portion, adapted to make the spring contact return to rest, and wherein, at the end of the actuator pin, opposite where the portion and the seat are situated, a seat is adapted to receive a tool.

6. A connector as in claim 5, wherein a bottom edge of the seat slopes downward.

7. A connector as in claim 5, wherein the conductor is released from the connector by inserting the tool, through the window, into the seat of the actuator pin and by levering with the tool on the bottom edge of the window to raise the actuator pin and to release the conductor from the spring contact.

* * * * *